US011814742B2

(12) United States Patent
Xu et al.

(10) Patent No.: US 11,814,742 B2
(45) Date of Patent: Nov. 14, 2023

(54) METHOD OF MASKING APERTURES IN A COMPONENT AND PROCESSING THE COMPONENT

(71) Applicant: General Electric Company, Schenectady, NY (US)

(72) Inventors: Sheng Xu, ShangHai (CN); Yanfei Gu, ShangHai (CN); Dalong Zhong, ShangHai (CN)

(73) Assignee: General Electric Company, Schenectady, NY (US)

( * ) Notice: Subject to any disclaimer, the term of this patent is extended or adjusted under 35 U.S.C. 154(b) by 95 days.

(21) Appl. No.: 16/967,947

(22) PCT Filed: Feb. 8, 2019

(86) PCT No.: PCT/US2019/017232
§ 371 (c)(1),
(2) Date: Aug. 6, 2020

(87) PCT Pub. No.: WO2019/164683
PCT Pub. Date: Aug. 29, 2019

(65) Prior Publication Data

US 2020/0370197 A1 Nov. 26, 2020

(30) Foreign Application Priority Data

Feb. 8, 2018 (CN) ..... 201810127577.7

(51) Int. Cl.
*C25D 13/12* (2006.01)
*C23C 4/02* (2006.01)
(Continued)

(52) U.S. Cl.
CPC ..... *C25D 13/12* (2013.01); *C23C 4/02* (2013.01); *C23C 28/3215* (2013.01);
(Continued)

(58) Field of Classification Search
CPC ..... C25D 13/12; C25D 13/00–13/24; C23C 4/02; C23C 28/3215; C23G 1/00;
(Continued)

(56) References Cited

U.S. PATENT DOCUMENTS 5,415,748 A 5/1995 Emiliani
5,702,288 A 12/1997 Liebke
(Continued)

FOREIGN PATENT DOCUMENTS

CN 103173820 A 6/2013
CN 103866323 A 6/2014
(Continued)

OTHER PUBLICATIONS

Chinese Search Report Corresponding to Application No. 201810127577 dated Oct. 23, 2020.
(Continued)

*Primary Examiner* — Alexander W Keeling
(74) *Attorney, Agent, or Firm* — Fitch, Even, Tabin & Flannery LLP

(57) ABSTRACT

The present invention relates to a method of processing a component, wherein the component comprises at least one opening in a surface thereof, the method comprising: placing the component in an electrophoretic fluid comprising particles of a masking material as an electrode, applying a voltage to the component and a counter electrode of the component, depositing particles of the masking material in the electrophoretic fluid into the at least one aperture through electrophoresis to mask the at least one aperture; processing a surface of the component; and removing the masking material in the at least one opening.

19 Claims, 7 Drawing Sheets

(51) Int. Cl.
*F01D 5/28* (2006.01)
*C25D 13/00* (2006.01)
*C23C 28/00* (2006.01)

(52) U.S. Cl.
CPC ..... *C25D 13/00* (2013.01); *F01D 5/288* (2013.01); *F05D 2230/90* (2013.01)

(58) Field of Classification Search
CPC ..... C25F 1/02; F01D 5/288; F05D 2230/90; F05D 5/288
See application file for complete search history.

(56) References Cited

U.S. PATENT DOCUMENTS

| | | | | |
|---|---|---|---|---|
| 5,813,118 | A * | 9/1998 | Roedl | C23C 10/04 29/889.7 |
| 5,976,337 | A * | 11/1999 | Korinko | B23K 1/0018 204/490 |
| 6,352,636 | B1 | 3/2002 | Wei | |
| 7,772,314 | B2 | 8/2010 | Fernihough | |
| 8,501,273 | B2 | 8/2013 | Creech | |
| 2001/0048972 | A1 | 12/2001 | Fernihough | |
| 2003/0108424 | A1 | 6/2003 | Masaki | |
| 2005/0191422 | A1* | 9/2005 | Fernihough | C23C 4/01 427/282 |
| 2010/0086680 | A1* | 4/2010 | Creech | C23C 18/08 427/237 |
| 2015/0000696 | A1 | 1/2015 | Ward, Jr. | |
| 2016/0083829 | A1 | 3/2016 | Reid | |
| 2016/0089692 | A1* | 3/2016 | Reid | B05D 1/28 427/282 |
| 2016/0348509 | A1* | 12/2016 | Malie | C25D 13/02 |
| 2018/0163547 | A1* | 6/2018 | Kirkendall | C25D 5/022 |

FOREIGN PATENT DOCUMENTS

| | | | | |
|---|---|---|---|---|
| CN | 103894305 | A | 7/2014 | |
| CN | 204530006 | U | 8/2015 | |
| CN | 107032829 | A | 8/2017 | |
| CN | 107304324 | A | 10/2017 | |
| EP | 1076107 | A1 * | 2/2001 | B23K 26/384 |
| EP | 2172579 | A2 | 4/2010 | |
| GB | 2237580 | A | 5/1991 | |
| JP | 2003/172102 | A | 6/2003 | |
| KR | 2013/0131625 | A | 12/2013 | |
| KR | 20150011710 | A | 2/2015 | |

OTHER PUBLICATIONS

PCT International Search Report Corresponding to PCT/US2019/017232 dated Oct. 24, 2019.

Ling, Zhang et al.; "Large Eddy Simulation on Compound Angle Film Cooling of Turbine Blades", The Tenth International Conference on Electronic Measurement & Instruments; 2011; pp. 282-287.

* cited by examiner

METHOD OF MASKING APERTURES IN A COMPONENT AND PROCESSING THE COMPONENT

TECHNICAL FIELD

The present invention relates to a method of masking an aperture in a component, and more particularly to a process of masking an aperture in a component and processing the component using the method.

BACKGROUND

When a gas turbine is used on an aircraft or used to generate electricity, it is usually required to operate at the highest possible temperature to achieve the greatest possible operational efficiency. Since high temperatures can damage the metal used to make the gas turbine components, various methods are commonly used in practical applications to protect the metal components of the gas turbine, such as rotor blades, stator blades, etc., to increase the actual operating temperature of the gas turbine. One of the methods is to provide cooling apertures in the component through which cooling air (usually provided by the compressor of the gas turbine) is supplied from the cooler side of the component to the hotter side, while the component is exposed to the surface of the hot operating gas of the gas turbine, thereby cooling the surface. As long as the cooling apertures remain open, rapid air can help reduce the temperature of the components, thereby preventing the components from melting or degradation. Therefore, a large number of cooling apertures are usually provided inside the gas turbine component.

In addition, most gas turbine components typically have an oxidation and/or corrosion resistant coating, such as an MCrAlY coating, which can be referred to as a base coating, while some components are also insulated using a thermal barrier coating (TBC) system. The environments under which gas turbines operate often result in coatings on these components that are more susceptible to degradation than component substrates. Therefore, during the service life of the component, it is typically subjected to at least one coating repair, i.e., removing the original coating that has degraded, and then applying a new coating.

For components with a large number of cooling apertures inside, many problems arise during the process of removing the original coating and reapplying a new coating, especially if the diameter of the apertures is less than 1 mm. The removal process used for the removal of the original coating may adversely affect the cooling apertures. For example, physical removal often leads to deformation and clogging of the cooling apertures, while chemical removal may corrode the cooling apertures and resulting in the deformation of the inner surface. When a new coating is applied, the applied coating material can enter the cooling apertures, covering or at least partially blocking the cooling apertures or changing the cross-sectional shape of the cooling apertures. These results may have a significant negative impact on the efficiency of the cooling apertures.

Any blockage of the apertures during operation of the gas turbine may affect the passage of cooling air, wasting compressor power, and may cause overheating and thereby resulting in damages to the gas turbine components. However, the shape change of the cooling apertures may also cause the cooling air to flow poorly, especially for some cooling apertures with a specific shape, since it is particularly sensitive to the accuracy of the shape of the apertures.

The shape change of the apertures will adversely impact the flow of the cooling air, resulting in a significant impact on the cooling efficiency.

At present, a variety of methods have been used to shield the cooling apertures when applying a coating to the components in order to prevent the applied coating material from entering the cooling apertures and to minimize changes in the shape and size of the cooling apertures. For example, when applying a coating to a component, the cooling aperture is shielded by a water-soluble or high-temperature volatilizable plug, and after the new coating is applied, the plug is removed by dissolution or volatilization. However, these methods usually requires individual shielding of the cooling apertures, or it is necessary to wait for the plugs to be formed inside the cooling apertures, which are very time consuming, laborious, and inefficient.

Therefore, new technologies are needed to solve at least one of the above problems.

SUMMARY

It is an object of the present invention to provide a method for masking an aperture in a component that can be used to prevent apertures in the component from being affected by the processing or repair process during the handling or repair processes of various components.

A method of processing a component, wherein the component comprises at least one opening in a surface thereof, the method comprising: placing the component in an electrophoretic fluid comprising particles of a masking material as an electrode, applying a voltage to the component and a counter electrode of the component, depositing particles of the masking material in the electrophoretic fluid into the at least one aperture through electrophoresis to mask the at least one aperture; processing a surface of the component; and removing the masking material in the at least one opening.

A method of repairing a component, wherein the component comprises a substrate, an outer layer on the substrate, and at least one aperture extending through the outer layer and into the substrate, the method comprising: placing the component in an electrophoretic fluid comprising particles of a masking material as an electrode, applying a voltage to the component and a counter electrode of the component, depositing particles of the masking material in the electrophoretic fluid into the at least one aperture through electrophoresis to mask the at least one aperture; and removing at least a portion of the outer layer.

BRIEF DESCRIPTION OF DRAWINGS

To read the following detailed description with reference to the accompanying drawings can help understand the features, aspects and advantages of the present invention, where.

DETAILED DESCRIPTION OF EMBODIMENTS

Figure 1:
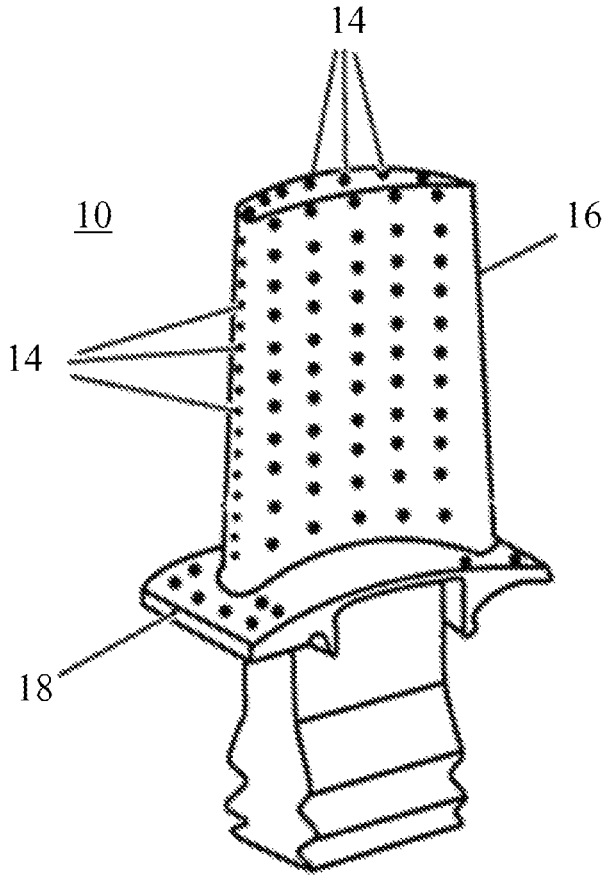
FIG. 1 shows a turbine blade with cooling apertures.

Unless otherwise defined, the technical and scientific terms used in the claims and the specification are as they are usually understood by those skilled in the art to which the present invention pertains.

"Comprise", "include", "have", and similar terms used in the present application are meant to encompass the items listed thereafter and equivalents thereof as well as other additional items. The terms "one", "a" and similar words are not meant to be limiting, but rather denote the presence of at least one. The term "or" does not denote exclusiveness, but refers to presence of at least one of the mentioned items (such as ingredients), and includes a situation where a combination of the mentioned items exists.

The approximate language used herein can be used for quantitative expressions, indicating that there is a certain amount of variation that can be allowed without changing the basic functions. Thus, numerical values that are corrected by language such as "approximately" or "about" are not limited to the exact value itself. In addition, in the expression "from approximately the first value to the second value", "approximately" corrects both the first value and the second value at the same time. In some cases, the approximate language may be related to the accuracy of the measuring instruments. The numerical values mentioned in the present invention include all values added from one unit to one unit from low to high, and it is assumed here that any lower value and higher value are separated by at least two units.

"Some embodiments" and the like mentioned in the present application specification represent that specific components (such as a characteristic, structure, and/or feature) related to the present invention are included in at least one embodiment described in the specification, and may or may not appear in another embodiment. In addition, it should be understood that the invention components can be combined in any manner.

Embodiments of the invention relate to a method for masking at least one aperture in a component. The component comprises at least one opening in the surface thereof, by which the opening of the aperture can be avoided or reduced by subsequent processing and operation on the surface of the component.

In some embodiments, the component comprises a base, an outer layer, and an aperture extending through the outer layer and into the base. The method can be used to remove at least one of the damaged outer layer and apply a new coating to mask apertures in the component in order to avoid or reduce the aperture being subjected to the impact of the operation to remove or apply the outer layer. Examples of such components include, but are not limited to, various internal cooling apertures for a gas turbine/engine having a metal substrate and at least one outer coating, such as a thermal barrier coating (TBC). As used herein, "masking" refers to partially filling or completely filling the apertures with a certain material (mask material) to close the surface opening of the apertures, thereby allowing the interior of the apertures to be as free from the impact of processes and operations carried out on the surface of the component as possible.

In some embodiments, the apertures in the component to be treated may be masked by electrophoretic deposition, in particular, the component may be placed in an electrophoretic fluid containing particles of the masking material, as an electrode (cathode or anode), while also placing another counter electrode, applying a voltage to the component and the counter electrode such that particles of the masking material in the electrophoretic fluid are preferentially (relative to the surface of the component) deposited into the aperture of the component, thereby closing the opening of the aperture. During the electrophoretic deposition, whether the component to be treated acts as a cathode or as an anode depends on the charge being carried by the masking material.

Usually, the surface of the component is covered with a layer of material that is less conductive than the substrate of the component, such as an electrically insulating material that is substantially non-conductive, allowing the masking material to preferentially enter the cooling apertures in the component, rather than preferentially depositing on the surface of the component, or substantially deposited on the surface of the component.

In some embodiments, the outer layer of the component to be processed (e.g., a ceramic thermal barrier coating) has a lower electrical conductivity than its substrate (e.g., a metal substrate), in which case the component to be processed is placed directly into the electrophoretic fluid, whereby electrophoretic deposition allows the masking material to be preferentially deposited onto the inner walls of the apertures formed in the substrate rather than the surface of the component. The masking material deposited in the apertures is stacked together to block the apertures, thereby realizing the function of masking the apertures. For example, the component to be repaired comprising the surface of the metal substrate and the ceramic thermal barrier coating can be directly placed in the electrophoretic fluid for electrophoretic deposition, such that the masking material in the electrophoretic fluid is preferentially deposited into the apertures of the component to be repaired.

The electrophoretic fluid is typically a suspension of colloidal particles suspended in a liquid medium. Specifically, in the present context, the electrophoretic fluid may be a suspension in which particles of the masking material are suspended in a liquid medium. The masking material can be any material suitable for forming a suspension in particulate form and capable of carrying a charge for electrophoretic deposition, including but not limited to organic compounds, inorganic non-metals, and metals. In some embodiments, the masking material comprises at least one of an organic compound, a ceramic material, a metal, and a composite thereof. In some embodiments, the masking material comprises at least one of a polymer, a wax, a ceramic, a metal, and a composite thereof. In some embodiments, the masking material comprises an organic polymer compound such as a polymer, and the crosslink of the polymer material is advantageous for plugging apertures, therefore it is particularly suitable for use in the embodiment of the present application for masking apertures in the component to be processed. In some embodiments, the masking material is a resin, such as an acrylic epoxy.

FIG. 1 shows a component 10, such as a blade of a turbine engine, having a plurality of cooling apertures 14 that open to the outer surface of the component, such as an airfoil 16 of the blade and an outer surface of the platform portion 18.

When processing the surface of the component 10, such as applying a coating to the surface of the component 10, or removing at least one layer of the surface of the component 10, it is generally necessary to first conceal the opening of the cooling aperture 14 at the surface, for example, blocking the cooling aperture 14, such that the inside of the cooling aperture 14 is not affected by the subsequent processing, and after the corresponding subsequent processing is finished, the masked cooling aperture 14 is opened. For example, when the outer surface of the component 10 is damaged, such as when the thermal barrier coating on the surface of the substrate is damaged, the damaged coating is removed and a new coating is applied, the cooling apertures 14 are masked during the removal of the damaged coating and during the application of the new coating. In some embodiments, the process of removing the damaged coating and the process of applying the new coating may share the same masking process, i.e., the cooling apertures 14 at the opening of the outer surface of the component may be masked, and then the damaged coating is removed, and a new coating is applied, and then the masking material is removed to reopen the cooling apertures 14. In some embodiments, a separate masking process is performed prior to the process of removing the damaged coating and the process of applying the new coating, i.e., masking the cooling apertures 14 to remove the damaged coating, and then removing the masking material to reopen the cooling apertures 14, and then masking the cooling aperture 14 again, applying a new coating, and finally the masking material is removed to reopen the cooling apertures 14.

In some embodiments, the process of removing the damaged coating comprises pickling, thus requiring the masking material in the apertures to have a relatively dense structure sufficient to resist corrosion that may be experienced during the pickling process. In some embodiments, the process of applying a new coating comprises thermal spraying, thus requiring the masking material in the apertures to have some heat resistance. It can be seen that the process of removing the damaged coating and the process of applying the new coating may have different requirements for the masking treatment of the apertures, and the suitable masking material and/or the parameters for controlling the electrophoretic deposition may be selected to obtain both requirements. The masking structure can also perform two separate masking processes for each of the two processes.

Figure 2:
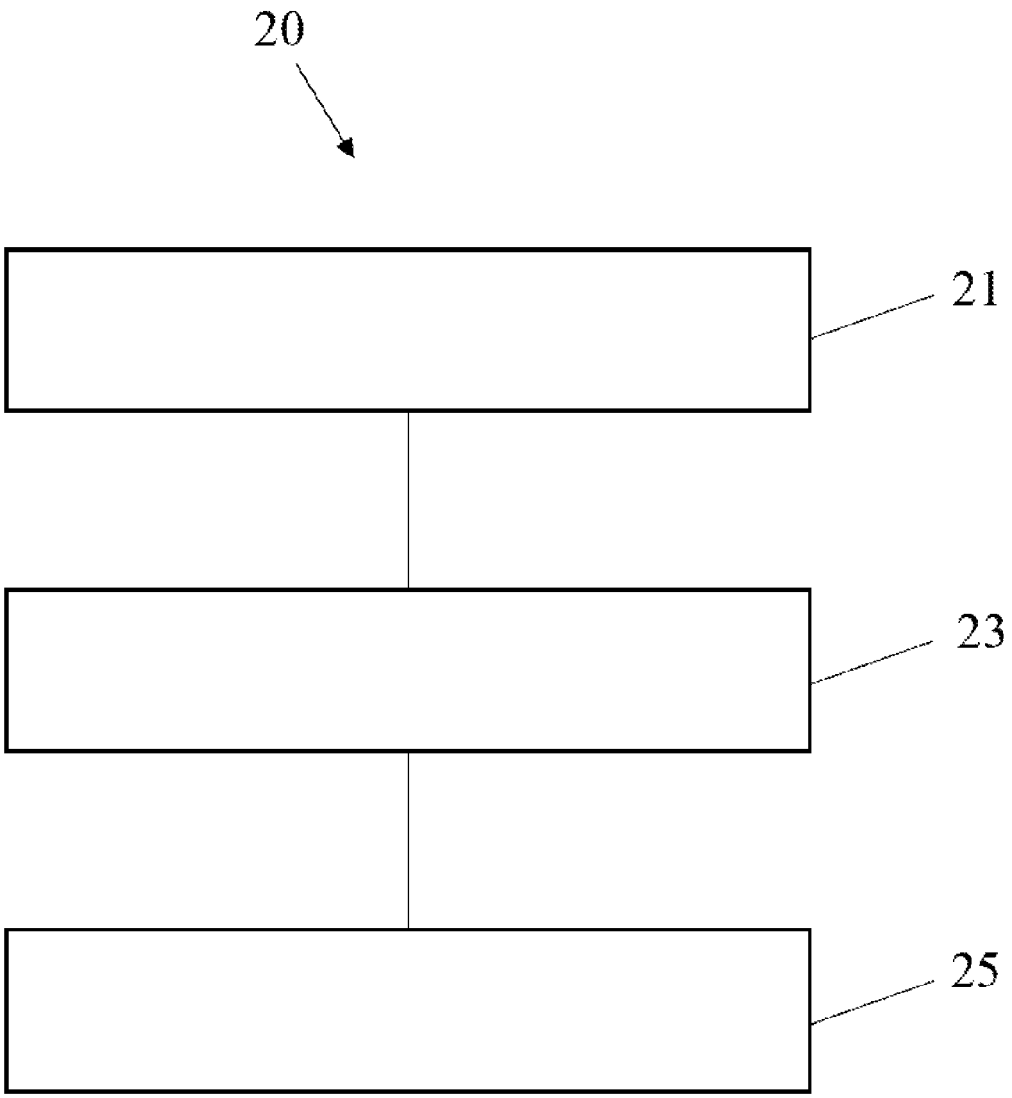
FIG. 2 is a flow diagram of a method of masking apertures and processing components in a component, in accordance with one embodiment of the present invention.

FIG. 2 shows a method 20 of processing a component, comprising: in step 21, placing a component comprising an opening in a surface thereof into an electrophoretic fluid comprising particles of a masking material as an electrode, applying a voltage to the component and a counter electrode of the component, depositing particles of the masking material in the electrophoretic fluid into the apertures of the component through electrophoresis to mask the apertures; in step 23, processing the surface of the component; and in step 25, removing the masking material within the aperture.

In some embodiments, the component comprises a substrate and an outer layer that is located on the substrate and providing the surface, with the outer layer having a lower electrical conductivity than the substrate, or in particular, the outer layer is substantially non-conductive, the aperture extending through the outer layer and into the substrate, the step 23 comprises removing at least a portion of the outer layer and applying at least one type of coating on the surface.

Since the conductivity of the outer layer is lower than the substrate (or substantially non-conductive), in the step 21, under the action of electrophoresis, the masking material is preferentially deposited into the apertures of the component instead of preferentially deposited onto the surface of the component, or only deposited into the aperture of the component, without substantially deposited onto the surface of the component.

Figure 3:
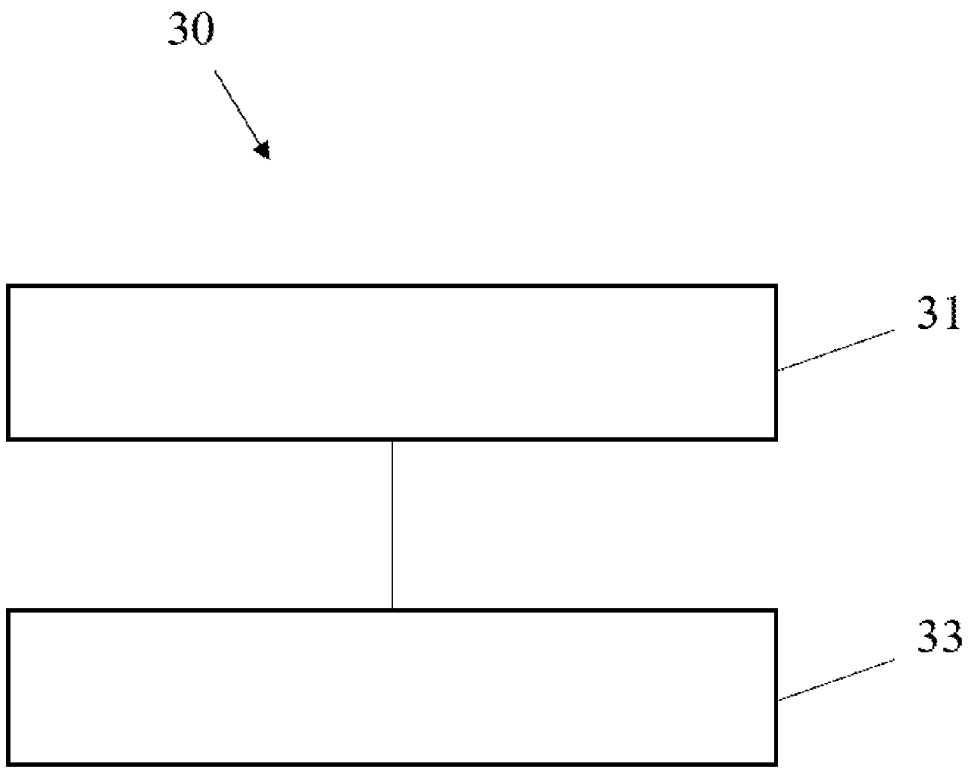
FIG. 3 is a flow diagram of a method of masking an aperture in a component and repairing the component, in accordance with one embodiment of the present invention.

FIG. 3 shows a method 30 of repairing a component comprising: in step 31, placing into an electrophoretic fluid including particles of masking material as an electrode, a component comprising a substrate, an outer layer on the substrate, and an aperture extending through the outer layer and into the substrate; applying a voltage to the component and a counter electrode of the component, depositing particles of the masking material in the electrophoretic fluid into the apertures of the component through electrophoresis to mask the apertures; and in step 33, removing at least a portion of the outer layer.

Specifically, in the step 31, the masking material enters a depth at which the aperture is located within the component substrate, such that in step 33, at least a portion of the outer layer can be removed while the aperture in the substrate is still masked by the masking material. In practice, the masking material can be caused to block the portion of the aperture that is within the outer layer of the component and the aperture that is located at least adjacent the outer layer of the component substrate. In some particular embodiments, the masking material may also be caused to block the entire aperture, including its portion on the outer layer of the component and the substrate of the component.

In some embodiments, the method 30 further comprises: removing the masking material within the aperture to open up the aperture.

In some embodiments, the method 30 further comprises: applying a coating on a surface of the component and then removing the masking material within the aperture to open up the aperture.

In some embodiments, the method 30 further comprises: removing the masking material within the aperture, then remasking the aperture, then applying a coating on the surface of the component, and then opening up the remasked aperture. The method of remasking the apertures may utilize the same or different method and/or masking material as in step 31.

In some embodiments, the step of removing at least a portion of the outer layer comprises physical removal and chemical removal. Examples of physical removal include, but are not limited to, sand blasting, high pressure water jetting, laser ablation, and examples of chemical removal include, but are not limited to, pickling and electrochemical stripping. In some specific embodiments, the step to remove at least a portion of the outer layer comprises at least one of sand blasting and pickling. In some specific embodiments, the outer layer comprises a thermal barrier coating and an adhesive layer between the thermal barrier coating and the substrate, the step to remove at least a portion of the outer layer comprising: a method comprising sand blasting to remove the thermal barrier coating and a method comprising pickling to remove the adhesive layer.

In some embodiments, the step of removing the masking material within the aperture comprises high temperature oxidation to remove the masking material.

EMBODIMENTS

Figure 4:
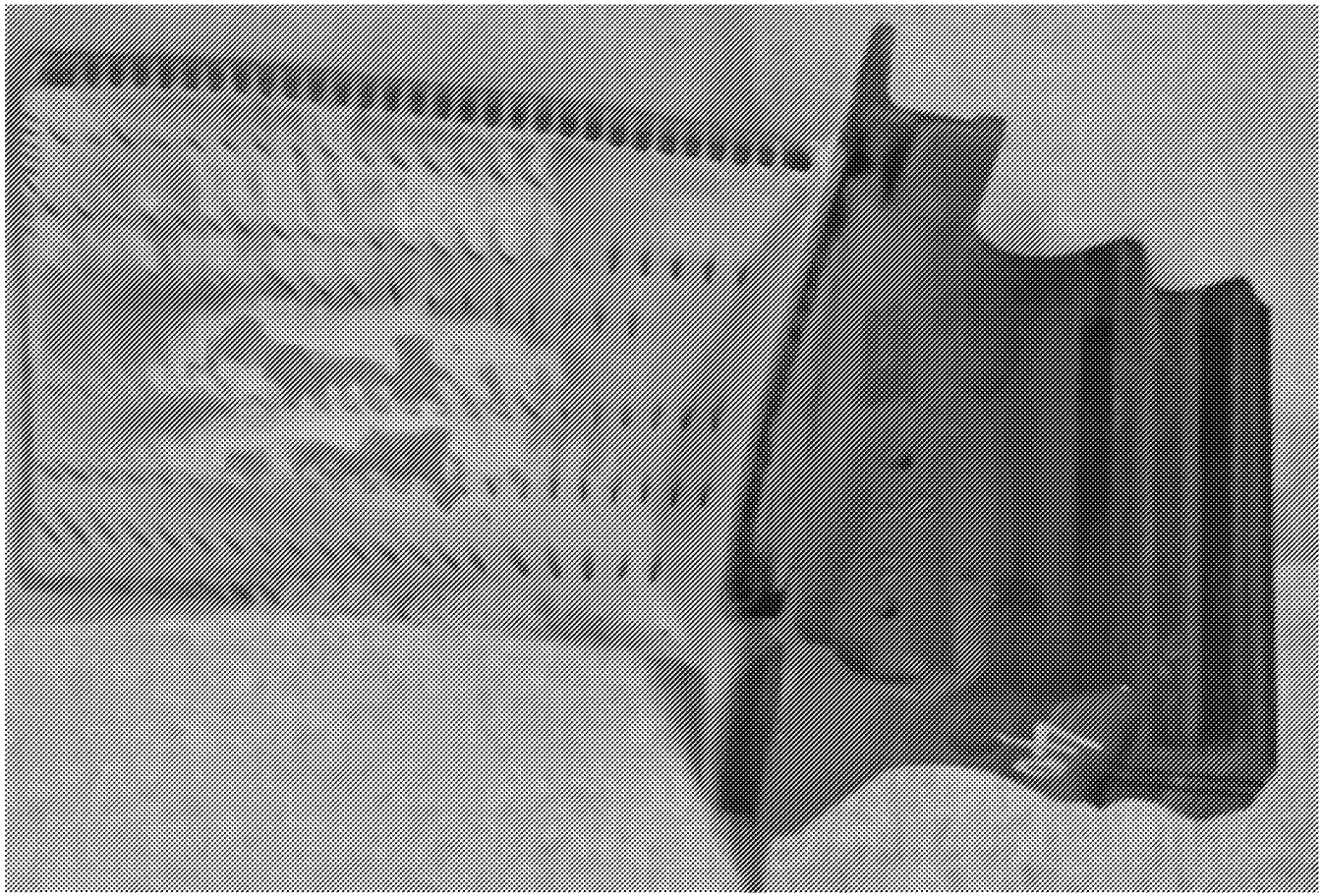
FIG. 4 shows the blade to be repaired with a thermal barrier coating used in the examples of the present invention.
Figure 5:
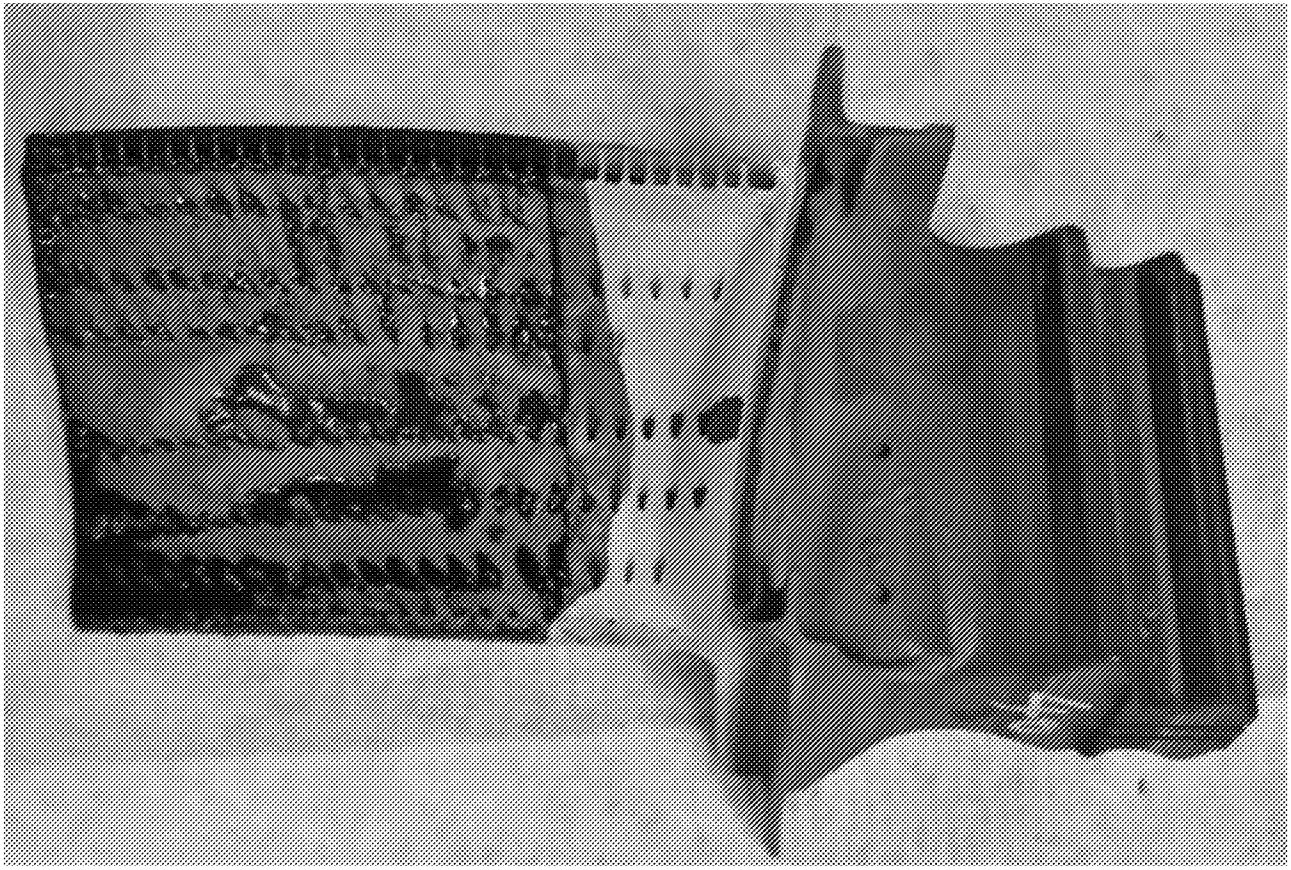
FIG. 5 shows a state in which the cooling apertures in the blade to be repaired shown in FIG. 4 are masked.
Figure 6:
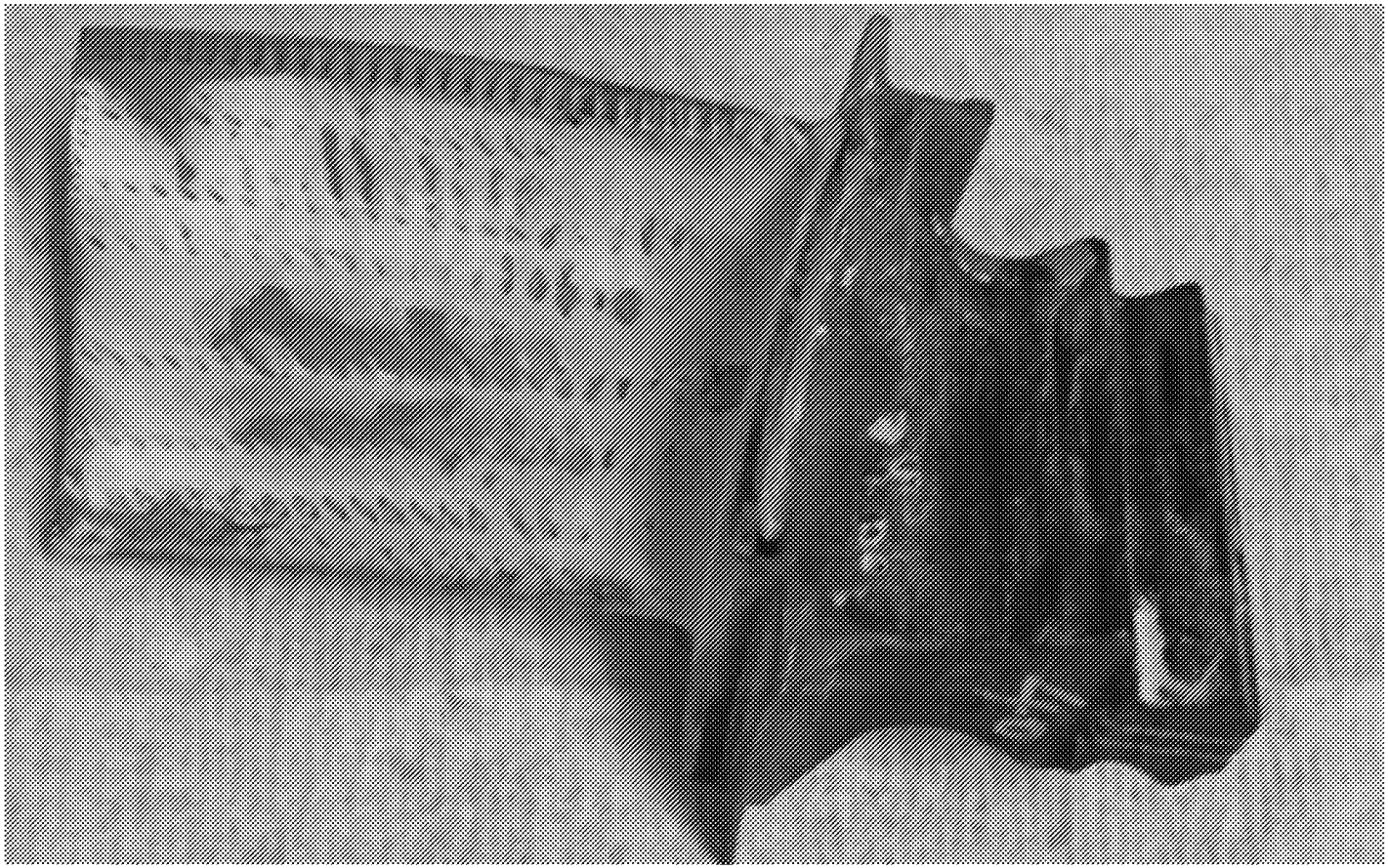
FIG. 6 shows a state in which the thermal barrier coating of the surface of the blade to be repaired shown in FIG. 5 is partially removed.
Figure 7:
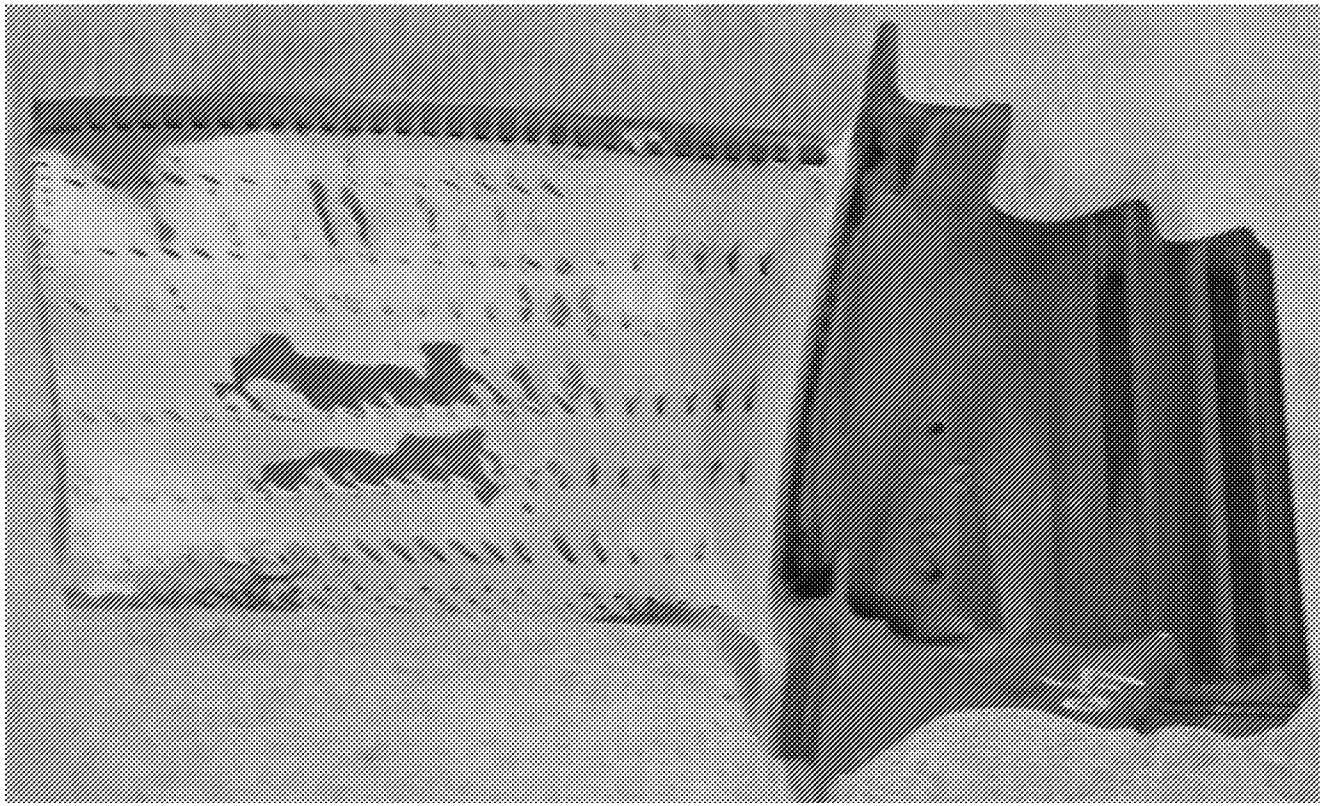
FIG. 7 shows a state in which the cooling apertures are reopened after the masking material in the cooling apertures in the blade to be repaired shown in FIG. 6 is partially removed.

Using acrylic epoxy as a masking material, the blade to be repaired having a ceramic thermal barrier coating as shown in FIG. 4 is immersed in an electrophoretic fluid containing acrylic epoxy particles as a cathode, and the other blade is used as an anode. The cathode and the anode are applied with a voltage of 10 to 300 V for electrophoretic deposition for 1 to 30 minutes, during which the particles of the acrylic epoxy resin enter the cooling apertures of the blade to be repaired. After the electrophoretic deposition is completed, the blades filled with the acrylic epoxy resin in their cooling apertures are baked at a temperature of about 160° C. for about 20 minutes, such that the acrylic epoxy resin in the cooling apertures is formed with a structure that is dense and robust, thereby making it very good at masking the cooling apertures (as shown in FIG. 5). The blades, which are masked by the cooling apertures, are then sand blasted to remove the thermal barrier coating from the surface of the blades. FIG. 6 shows the state in which the thermal barrier coatings of the blades are partially removed, at which time the cooling apertures are still blocked by the acrylic epoxy. The acrylic epoxy in the cooling apertures of the blade is then removed by high temperature oxidation to open up the cooling apertures of the blades, and the blades after the cooling apertures are opened are as shown in FIG. 7. Through the water spray test, it was found that the cooling apertures were opened and the water flow could be smoothly discharged.

The method of masking the apertures in the component to be processed through electrophoretic deposition is able to mask a large number of apertures in the component within a short period of time, for example, within ten minutes. Moreover, the method is able to obtain a dense and robust masking structure with a variety of masking materials such that the masked components can undergo various types of subsequent processing.

While the present invention has been described with reference to specific embodiments thereof, it will be understood by those skilled in the art that many modifications and variations can be made thereto. It is, therefore, to be understood that the appended claims are intended to cover all such modifications and variations insofar as they are within the true spirit and scope of the invention.

What is claimed is:

1. A method of processing a component, wherein the component comprises a substrate, an outer layer on the substrate and providing a surface of the component, and at least one aperture extending through the outer layer and into the substrate, the method comprising:

placing the component in an electrophoretic fluid comprising particles of a masking material as an electrode, applying a voltage to the component and a counter electrode of the component, depositing the particles of the masking material in the electrophoretic fluid into the at least one aperture through electrophoresis to fill the at least one aperture with the masking material;

processing the surface of the component comprising removing at least one portion of the outer layer;

removing the masking material in the at least one aperture;

placing the component in the electrophoretic fluid comprising the particles of the masking material as the electrode, applying the voltage to the component and the counter electrode of the component, depositing the particles of the masking material in the electrophoretic fluid into the at least one aperture through electrophoresis to fill the at least one aperture with the masking material;

processing the surface of the component comprising applying at least one type of coating on the surface; and removing the masking material in the at least one aperture.

2. A method according to claim 1, wherein the outer layer having a lower electrical conductivity than the substrate, and wherein steps to remove the at least one portion of the outer layer comprises at least one of sand blasting, water jetting, laser ablation, electrochemical stripping, and pickling.

3. A method according to claim 1, wherein the outer layer comprises a thermal barrier coating and an adhesive layer between the thermal barrier coating and the substrate, steps to remove the at least one portion of the outer layer comprise: removal of the thermal barrier coating by a method comprising sand blasting and removal of the adhesive layer by a method comprising pickling.

4. A method according to claim 1, wherein the outer layer comprises an electrically insulating layer, steps to treat the surface of the component comprises removing the electrically insulating layer.

5. A method according to claim 1, wherein the masking material comprises at least one of an organic compound, a ceramic material, a metal, and their composite thereof.

6. A method according to claim 1, wherein the removing of the masking material in the at least one aperture comprises high temperature oxidation.

7. A method according to claim 1, wherein the masking material comprises acrylic epoxy.

8. A method according to claim 1, wherein the at least one aperture is fully filled with the masking material.

9. A method according to claim 1, wherein the removal of the masking material in the at least one aperture at a first time is subsequent to the removal of the at least one portion of the outer layer, and wherein the removal of the masking material in the at least one aperture at a second time is subsequent to the application of the at least one type of coating on the surface.

10. A method of repairing a component, wherein the component comprises a substrate, an outer layer on the substrate, and at least one aperture extending through the outer layer and into the substrate, the method comprising:

placing the component in an electrophoretic fluid comprising particles of a masking material as an electrode, applying a voltage to the component and a counter electrode of the component, depositing the particles of the masking material in the electrophoretic fluid into the at least one aperture through electrophoresis to fill the at least one aperture with the masking material;

removing at least a portion of the outer layer;

removing the masking material in the at least one aperture;

remasking the at least one aperture;

applying a coating on a surface of the component after remasking the at least one aperture; and opening the at least one aperture that has been remasked.

11. A method according to claim 10, further comprising: applying a coating on a surface of the component prior to removing the masking material in the at least one aperture after removing at least the portion of the outer layer.

12. A method according to claim 10, wherein the outer layer comprises an electrically insulating layer, and steps to treat a surface of the component comprises removing the electrically insulating layer comprising sand blasting.

13. A method according to claim 10, wherein the outer layer has a lower electrical conductivity than the substrate such that the masking material is preferentially deposited onto inner walls of the at least one aperture comprising the substrate rather than on the outer layer.

14. A method according to claim 10, wherein the outer layer comprises a thermal barrier coating and an adhesive layer between the thermal barrier coating and the substrate, wherein the removing of at least the portion of the outer layer comprises: removal of the thermal barrier coating comprising sand blasting and removal of the adhesive layer comprising pickling.

15. A method according to claim 10, wherein the masking material comprises at least one of an organic compound, a ceramic material, a metal, and their composite thereof.

16. A method according to claim 10, wherein the removing of the masking material in the at least one aperture comprises high temperature oxidation.

17. A method according to claim 10, wherein the at least one aperture is fully filled with the masking material.

18. A method according to claim 10, further comprising baking the component after fully filing the at least one aperture.

19. A method of processing a component, wherein the component comprises a substrate, an outer layer on the substrate and providing a surface of the component, and at least one aperture extending through the outer layer and into the substrate, the method comprising:

placing the component in an electrophoretic fluid comprising particles of a masking material as an electrode, applying a voltage to the component and a counter electrode of the component, depositing the particles of the masking material in the electrophoretic fluid into the at least one aperture through electrophoresis to fill the at least one aperture with the masking material at a first time;

processing the surface of the component comprising removing at least one portion of the outer layer;

removing the masking material in the at least one aperture after removing the at least one portion of the outer layer;

placing the component in the electrophoretic fluid comprising the particles of the masking material as the electrode, applying the voltage to the component and the counter electrode of the component, depositing the particles of the masking material in the electrophoretic fluid into the at least one aperture through electrophoresis to fill the at least one aperture with the masking material at a second time that is later than the first time;

processing the surface of the component comprising applying at least one type of coating on the surface; and removing the masking material in the at least one aperture after applying the at least one type of coating on the surface.

* * * * *